US005615465A

United States Patent [19]

Broussoux et al.

[11] Patent Number: 5,615,465

[45] Date of Patent: Apr. 1, 1997

[54] PROCESS FOR MANUFACTURING METAL PARTS BY FREE FORGING AND DROP FORGING IN A PRESS

[75] Inventors: Dominique Broussoux, Linas; Jean Collard, Gif Aur Yvette; Marie-Thérèse Daumas, Orsay, all of France

[73] Assignees: Commissariat a l'Energie Atomique, Paris; Thomson-Brandt Armements, Saint-Aubin, both of France

[21] Appl. No.: 98,201

[22] Filed: May 7, 1993

[30] Foreign Application Priority Data

May 7, 1992 [FR] France ..... 92 05627

[51] Int. Cl.[6] ..... B21K 23/00

[52] U.S. Cl. ..... 29/1.21; 29/417; 72/377; 102/307

[58] Field of Search ..... 148/554, 681; 29/2, 417, 1.21, 1.2, 1.3; 102/306, 307, 308, 309, 310; 72/377

[56] References Cited

U.S. PATENT DOCUMENTS

| | | | |
|---|---|---|---|
| 2,312,830 | 3/1943 | Eldred | 148/2 |
| 3,255,659 | 6/1966 | Venghiattis | 86/20 |
| 3,375,108 | 3/1968 | Wyman, Sr. et al. | 75/202 |
| 4,551,287 | 11/1985 | Bethmann | 269/3 R |
| 4,598,643 | 7/1986 | Skrocki | 102/307 |
| 5,028,275 | 7/1991 | Peters et al. | 148/2 |
| 5,039,355 | 8/1991 | Daumas et al. | 148/554 |
| 5,331,895 | 7/1994 | Bourne et al. | 102/307 |

*Primary Examiner*—Charles T. Jordan
*Assistant Examiner*—Anthony R. Chi
*Attorney, Agent, or Firm*—William L. Feeney; Kerkam, Stowell, Kondracki & Clarke, P.C.

[57] ABSTRACT

The process for manufacturing parts of revolution which are made from a high-density metal with great regularity of reproducibility, especially as regards the homogeneity of the matter.

It consists in carrying out the following steps:

forging in three dimensions by successive upsetting and drawing-out operations carried out in three perpendicular directions;

closed-die forging; and recrystallisation heat treatment.

Application to the manufacture of hollow-charged coatings made of tantalum.

11 Claims, 3 Drawing Sheets

PROCESS FOR MANUFACTURING METAL PARTS BY FREE FORGING AND DROP FORGING IN A PRESS

DESCRIPTION

1. Field of the Invention

The invention relates to the working and forming of metal parts, the constituent material of which has a high density, such as tungsten, molybdenum, rhenium, uranium, tantalum and their alloys. It relates in particular to parts having a hollow shape of revolution, such as hollow charges or core-generating charges.

2. Prior Art and Problem Encountered

The search for improving the performance characteristics of hollow charges and of charges producing a jet of matter at very high speeds forces manufacturers to use heavier metals, that is to say metals of very high density. Attempts are thus made to manufacture hollow-charge coatings consisting of very heavy metals. Now, the reproducibility in the manufacture of core-generating charges depends on numerous technological parameters related to the design of the charge system, but especially on the reproducibility of the metallurgical structure used for constituting the coating of the charge. In particular, high-density coatings, such as tantalum, cannot be mass-manufactured to a consistent quality regarding performance characteristics, especially when the quality of the metallurgical structure has not been made consistent.

The object of the invention is to overcome this drawback by providing a process for forging and recrystallising heavy metals, such as tantalum, which obliterates the structural history of the starting material and which makes it possible to obtain parts which are isotropic and have a fully reproducible and fine-grained structure.

Moreover, a process is known, from European Patent Application 0,389,367, for obtaining parts made from copper having a very fine structure, starting from a continuous-cast billet. This process comprises the following principal phases:

kneading the billet by upsetting and drawing-out cycles;

sectioning the billet into blanks each intended to form a finished part;

die-forming the blanks at room temperature; and recrystallization heat treatment in order to obtain a grain size below 40 μm.

The first kneading phase comprises in particular a first upsetting of the billet, a first drawing out, a second upsetting and then a second drawing out. These four operations are carried out at a temperature of between 400° and 480° C.

Now, the drawings of this patent application show that these various upsetting and drawing-out phases are always performed along the same initial axis of the billet, that is to say the upsetting operations and drawing-out operations are performed along the same axis of the billet.

This process only works the constituent matter of the billet in two dimensions. The operation in the third direction is only undertaken during the drop forging of the part.

SUMMARY OF THE INVENTION

The main subject of the invention is a process for manufacturing metal parts by free forging and drop forging in a press, starting from billets, each of which is associated with an orthogonal mark having three dimensions X, Y, Z, the process comprising the following steps:

first upsetting along the first axis X;

first drawing out;

second upsetting;

second drawing out;

die forging; and recrystallization heat treatment.

According to the invention, the first drawing out is performed along the second axis Y, the second upsetting is performed along the second axis Y and the second drawing out is performed along the third axis Z.

The process according to the invention is particularly intended to be applied to high-density materials; it is thus performed at room temperature.

Quench cooling operations may be effected after certain steps or between certain operations of certain steps.

Preferably, the first upsetting along the first axis X is performed in the press and comprises:

a single upsetting operation with a forging ratio T of less than 2.3; and a quench.

The first drawing out along the second axis Y is preferably performed in the press by:

a squaring by pressure on the faces perpendicular to the first and third axes X and Z;

a first drawing out by pressure on the edges parallel to the axis Y in order to obtain an octagonal profile;

a quench;

a drawing out by pressure on the center in order to cause the center of the blank to neck;

a quench;

a second drawing out by action on the faces parallel to the axis Y in order to obtain an octagonal profile;

a drawing out by pressure on the edges of the octagon in order to round off the part, that is to say to obtain a virtually cylindrical external surface; and a quench.

The second upsetting along the axis Y is preferably performed in the press by means of the following steps:

forging the end faces in order to provide a bearing surface on each of them;

upsetting, in one or more operations, with a forging ratio of less than 2.3, each operation followed by a quench.

The second drawing out along the axis Z is preferably performed in the press by means of the following operations;

squaring by action on the faces perpendicular to the first and second axes X and Y;

quenching;

drawing out by pressure on the center in order to cause the center of the blank to neck;

squaring by action on the faces X and Y;

drawing out by pressure on the center in order to cause the center of the blank to neck;

drawing out by pressure on the faces perpendicular to the first and second axes in order to obtain an octagonal profile;

drawing out by pressure on the edges of the octagon in order to round off; and a quench.

Before carrying out the die forging of thin parts, the following are preferably carried out;

a cutting-up of the billet in order to obtain discs;

a facing, by turning, of the plane end faces of the discs.

The forging is preferably performed by means of the following steps:

closed-die forging in a press;

sizing with a drop hammer; and quenching.

In cases where the material is tantalum, the recrystallization heat treatment is performed at a temperature in the neighborhood of 970° C. for approximately 1 h and is carried out under vacuum.

BRIEF DESCRIPTION OF THE DRAWINGS

The invention and its various characteristics will be better understood on reading the following description, accompanied by various figures representing respectively.

DETAILED DESCRIPTION OF AN EMBODIMENT OF THE INVENTION

The process according to the invention can in particular be produced with various materials and billets of different dimensions, but in particular with tantalum billets of 70 mm in diameter and 140 mm in height.

Figure 1:
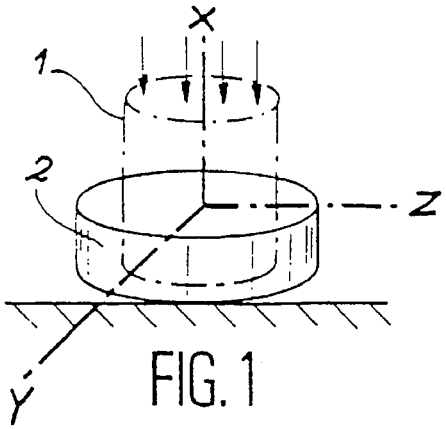
FIG. 1, the first upsetting of the process according to the invention.

Such a billet is shown in FIG. 1. An orthogonal mark having three axes X, Y and Z is associated with this billet and will remain associated with it throughout the description of the process. This will make it possible to better define the various directions in which the various deformations are applied to the billet. This mark must be displayed on the billet in order to facilitate the execution of the process.

FIRST STEP: first upsetting along the first axis X.

The first step of the process consists in carrying out a first upsetting along the first axis X, placed vertically in FIG. 1. Depending on the size and the material, this upsetting is carried out in one or more operations in a press. The forging ratio T, that is to say the ratio of the initial dimension along the relevant axis and the final dimension, is of the order of 2. For parts made of tantalum, it may go up to 2.3. Above this value, buckling problems occur.

The operation is performed at room temperature in the case of tantalum. A quench may optionally be carried out after each successive operation. In fact, since the deformation of the shape of the billet is relatively great, corresponding internal heating occurs within the material bulk.

In the case of a tantalum billet of 140 mm in height and 70 mm in diameter, this first operation may be carried out in a single deformation in a 1,200-tonne press at a rate of 5 mm/s. At the end of the deformation, the billet is preferably quenched, its surface temperature being able to fall below 100° C.

SECOND STEP: first drawing out along the second axis Y.

Referring to FIGS. 2A to 2F, the second step of the process consists of a first drawing out. According to the invention, this drawing out is carried out along the second axis Y. In order to do this, the billet 2 is placed on edge, so that the first axis X is horizontal, the second axis Y is horizontal and faces the forgeman, the third axis Z being vertical. The various operations of this step are preferably also carried out in a press.

Figure 2A:
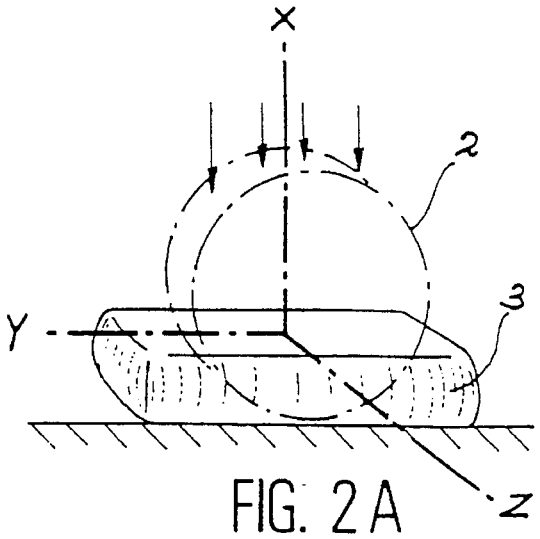
FIGS. 2A to 2F, the first drawing out in the process according to the invention.
Figure 2B:
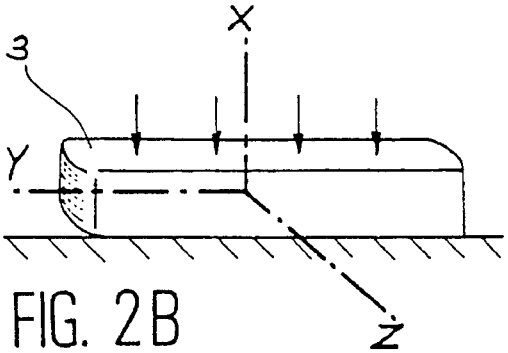
Figure 2C:
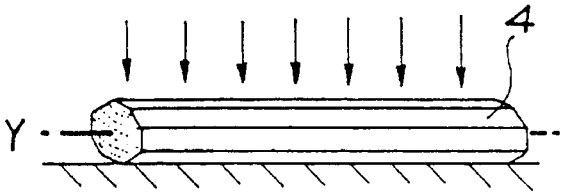
Figure 2D:
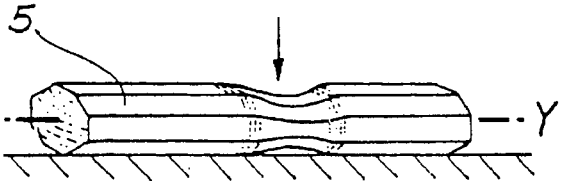
Figure 2E:
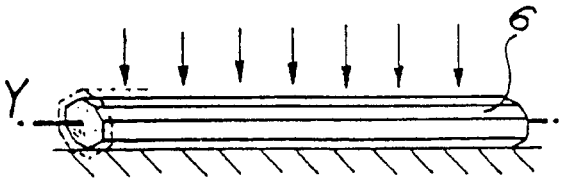
Figure 2F:
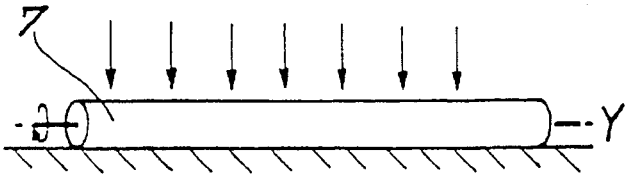

In the context of working tantalum billets, of the dimension described previously, the various operations may be the following.

a—First of all, squaring is carried out in order to obtain a billet of 70 mm sides. In order to carry out this operation, the billet may be rotated several times through 90° about the second axis Y in order to be able to carry out this squaring alternately along the first and third axes X and Z, as FIGS. 2A and 2B show. A quench may be carried out at the end of this squaring operation in order to cool down the billet 3.

b—With reference to FIG. 2C, the billet 4 is drawn out, still in the direction of the second axis Y, but so that its cross section perpendicular to the second axis Y is orthogonal. The octagon thus obtained may have a side equal to approximately 70 mm. This shape is obtained by acting on the edges which are perpendicular to the first and third axes X and Z and are obtained after the previous squaring. Of course, this octagonal drawing-out operation may be finished off with a quench.

c—Given the length of the billet 4 thus obtained, with reference to FIG. 2B, there is the need to cause the middle of this billet to neck. This operation consists in carrying out drawing out by pressure on the center of the billet 5. In fact, these previous drawing-out operations do not always force back the matter uniformly along the second axis Y. In particular, in the middle of the billet 5, this mass tends to be a little greater. The necking therefore makes it possible to even out the distribution of matter along the drawing-out axis, in this case the second axis Y.

d—With reference to FIG. 2E, the drawing out along the second axis Y is continued by the thinning of the octagon thus obtained in order to obtain an octagonal bar 6, the side of which is in the neighborhood of 65 mm. The press is again used to act on these various phases of the octagon which are parallel to the second axis Y.

e—This drawing out along the second axis Y may be finished off rounding off the billet 6 in order to obtain a cylindrical bar 7, as FIG. 2F shows. Of course, this drawing out along the axis Y may be finished off with a quench.

It should be pointed out that, in the case of tantalum billets, it is advantageous to proceed at room temperature.

During this drawing out, the forging ratio is approximately equal to 2. It may be slightly greater (2.3) and much less, of course.

THIRD STEP: second upsetting along the second axis Y.

Figure 3:
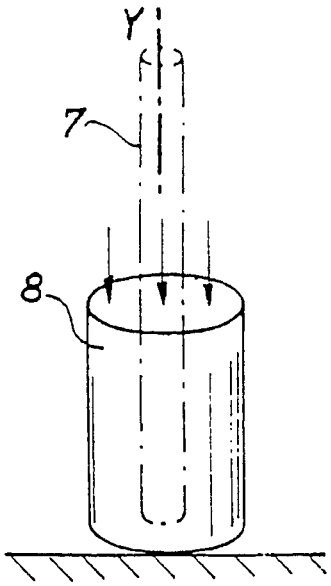
FIG. 3, the second upsetting in the process according to the invention.

Referring to FIG. 3, the process according to the invention consists in upsetting, along the second axis Y, the cylindrical bar 7 thus obtained by a drawing out along this same axis Y. The bearing faces 7A of the cylindrical bar 7 are very often not plane. In fact, the various previous operations tend to deform these two bearing faces 7A. In this case, the ends 7A may be taken up in the press by the forgeman in order to reform the bearing surfaces. Next, this bar 7 is placed on edge and is upset in the press to a ratio of 2, that is to say the bar 7 is reduced to half its length, while its diameter increases in order to give a cylindrical billet 8.

Given the very elongate shape of the bar 7, this upsetting may be carried out only after the verticality of the second axis Y is checked.

This third step is preferably finished off with a water quench.

FOURTH STEP: drawing-out along the third axis Z.

Figure 4A:
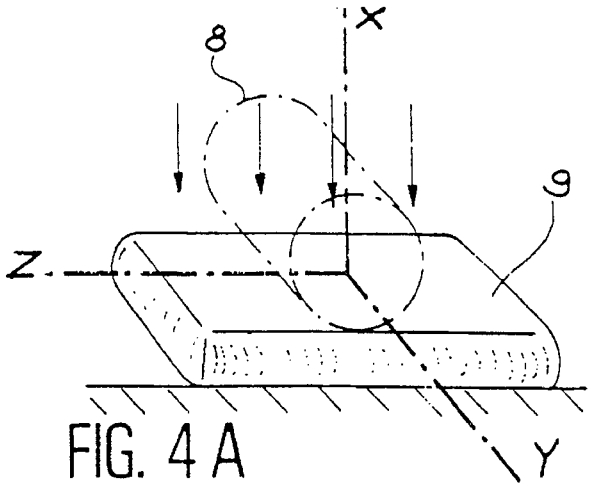
FIGS. 4A to 4G, the second drawing out in the process according to the invention.
Figure 4B:
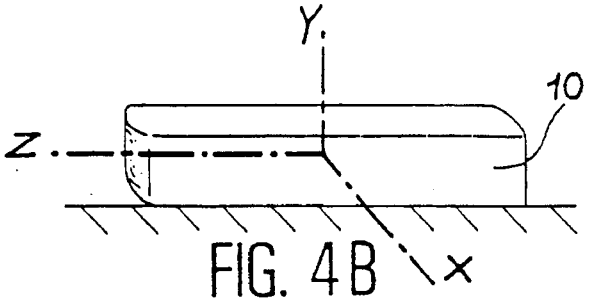

As FIGS. 4A to 4G illustrate, this fourth step consists in drawing out the billet 8 in the direction in which it has not yet been worked, namely the third axis Z. The various operations of this step, in the case of tantalum billets mentioned up to now in the present embodiment, may be the following.

a—With reference to FIGS. 4A and 4B, the first operation consists in squaring the cylindrical billet 8. The latter is therefore placed with its second axis Y horizontal and its first axis X vertical. The billet 8 is therefore upset in order to assume the shape of a flattened parallelepipedal billet 9.

As FIG. 4B shows, the billet 9 thus obtained is rotated about its third axis Z in order to place the first axis X horizontal and the second axis Y vertical. A billet 10 is thus obtained of square cross section, the side of which is approximately equal to 70 mm.

Figure 4C:
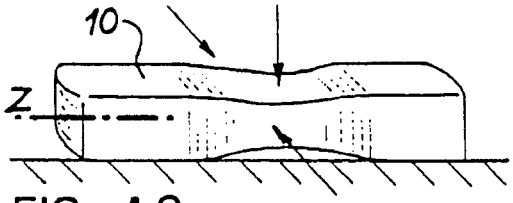
Figure 4D:
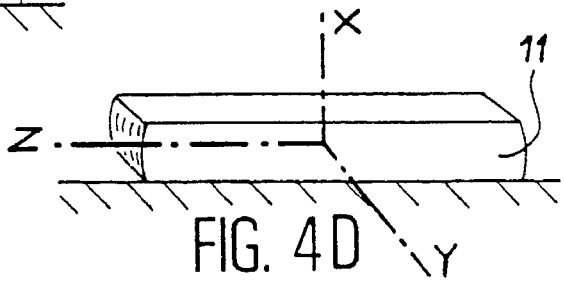
Figure 4E:
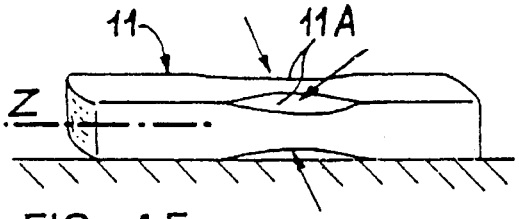
Figure 4F:
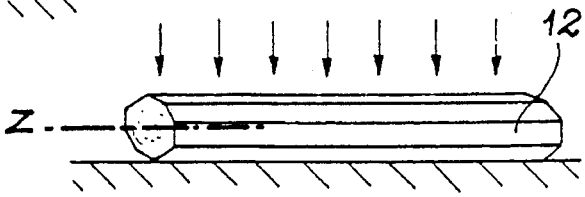

This first squaring operation may be finished off with a quench.

b—As FIG. 4C shows, a necking operation is provided in the middle of the square billet 10 thus obtained. Partial upsetting of the matter in the middle of the billet is therefore carried out for the reasons already mentioned previously. In the center of the bar, the cross section of the square may thus have a side equal to approximately 60 mm.

c—With reference to FIG. 4D, the square cross section of the billet 10 is evened out by squaring obtained by a drawing out along the third axis Z. A regular parallelepiped 11 of square cross section is thus obtained by acting along the first and second axes X and Y in a manner similar to the other squaring operations.

d—In order to improve the distribution of matter, especially in the middle of this billet 11, the longitudinal edges 11A of this billet 11 are caused to neck. In order to do this, the billet 11 is successively positioned on its four longitudinal edges 11A which undergo plating, one after the other. Each diagonal may thus be reduced to a value of 65 mm.

e—With reference to FIG. 4F, the drawing out along the third axis Z continues by actions on the four edges 11A of the billet 11 in order to obtain an octagonal bar of sides equal to approximately 65 mm.

During this fourth drawing-out step along the third axis Z, the forging ratio may be in the neighborhood of 2.3.

Of course, this drawing-out cycle may be finished off with a quench.

During these operations, phenomena such as forging pinches may appear. They are then systematically removed by chipping. The same applies to the previous drawing-out operation.

Figure 4G:
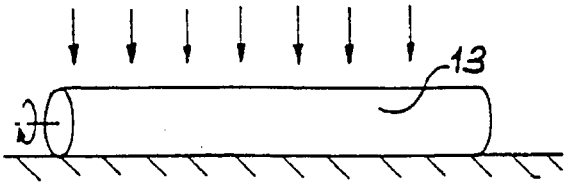

As FIG. 4G shows, this drawing out may possibly be finished off by rounding off the octagonal billet 12 obtained previously. A cylindrical bar 13 is thus produced which can be used directly for the manufacture of parts of revolution.

This cylindrical shape may also be obtained by machining the octagonal billet 12 of FIG. 4F on a lathe. During this turning, a 5-mm radius may be made on the edges of the two plane faces of the cylindrical billet 13.

FIFTH STEP: drop forging.

Figure 5:
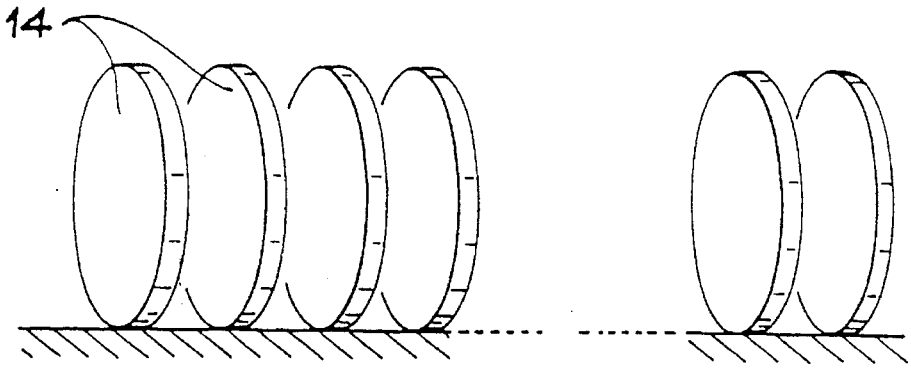
FIG. 5, the sectioning in the process according to the invention.

Depending on the shape of the parts to be manufactured, the billet 13 obtained after the fourth drawing-out step along the third axis Z, may be cut up into a large number of cylindrical parts. As FIG. 5 shows, for the manufacture of hollow-charge coatings of tantalum, it is advantageous to cut the billet up into a large number of discs 14. Moreover, it is possible, in order to facilitate this operation, to true up the faces of the billet 13 in a parallel lathe.

The first operation of the drop-forging step consists in deforming the billet by means of a press. In order to manufacture hollow charges made of tantalum, on the base of the billets already described, a 2,000-tonne press may be used with a rate of drop of the ram of 5 mm/s. The die tool used is preferably closed and non-deformable. The die 17 and the ram 16 may be lubricated with tungsten bisulphide. The closed-die tool shown in FIG. 6A comprises a fixed die 17 and a ram 16 which, once joined together, after the descent of the ram, form a closed space within which the billet 15 is deformed in order to adopt a specified intermediate shape.

Figure 6A:
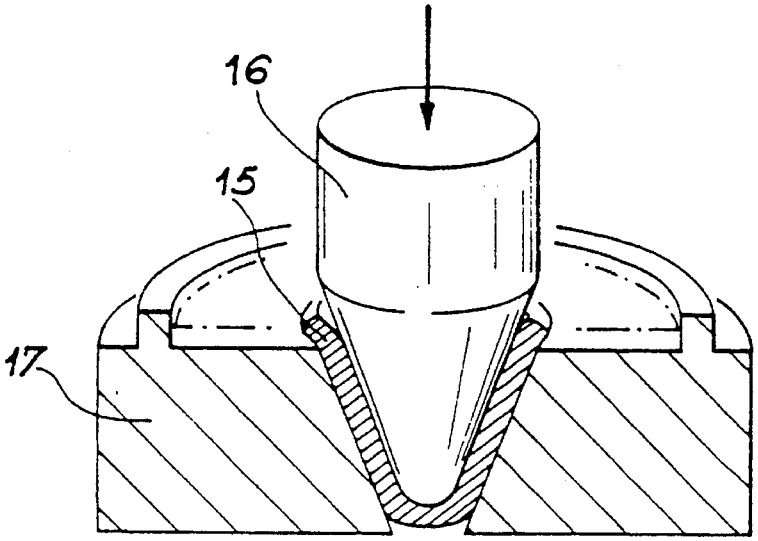
FIGS. 6A and 6B, the die forging in the process according to the invention.
Figure 6B:
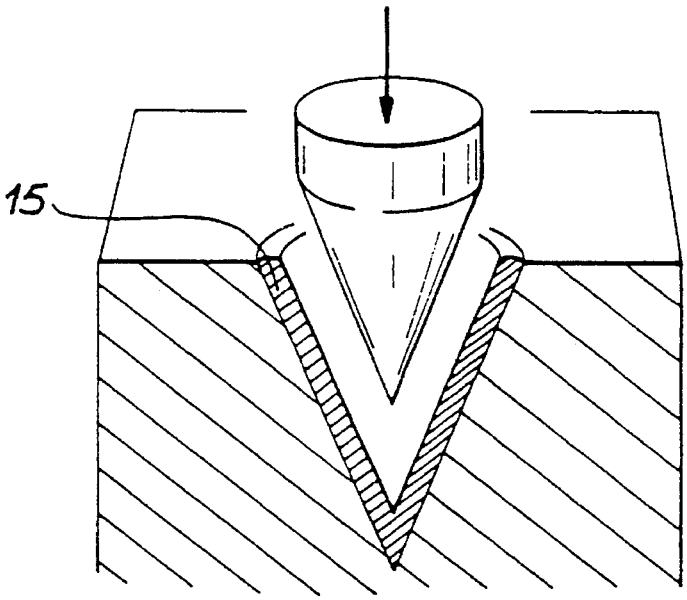

A second operation of the drop forging consists in carrying out the finishing of the forging by accurate sizing with a drop hammer (FIG. 6B). This is especially useful in the case of large-sized parts. The drop hammer used in the case of billets intended to constitute hollow charges made of tantalum has a force of approximately 9,000 kgm.

In this operation, the part has to be quenched upon opening the die tool.

During all these operations, the working temperature for parts made of tantalum which are intended for producing hollow-charge coatings is room temperature. This thermal arrangement is not limiting, but it constitutes one embodiment.

SIXTH STEP: recrystallization heat treatment.

This heat treatment is intended to promote the fineness of the grain size constituting the final coating. It turns out to be the case that, for parts made of tantalum, a recrystallization at 970° C. for approximately 1 h is carried out under secondary vacuum and enables a structure of the material to be obtained which is very homogeneous and very fine ($G<30$). In addition, such a structure makes it possible to have homogeneity from the center through to the edges of the part obtained while still retaining a very significant deformation structure. This example of recrystallization heat treatment is particularly well suited to the manufacture of coatings made of tantalum for hollow charges. This example is therefore in no way limiting. In order to facilitate all these working and forging operations, it is very useful to display the three axes X, Y and Z on each of the faces of the initial billet. Thus, the various forge operators who have to work this part will easily be able to position it along the specified axis along which they have to draw out or upset the part.

The various operations of the various steps described in this description are given by way of example, the principal concept of the invention being to upset and draw out the part along the three initial perpendicular directions defined by the orthogonal reference mark associated with the part, as explained at the beginning of the description.

We claim:

1. Process for manufacturing metal parts by free forging and drop forging in a press, starting from billets, each of which is associated with an orthogonal mark having three dimensions (X, Y, Z), the process comprising the following steps:

a first upsetting along the first axis (X) (FIG. 1);

a first drawing out (FIGS. 2A to 2F);

a second upsetting (FIG. 3);

a second drawing out (FIGS. 4A to 4G);

a die forging (FIGS. 6A and 6B); and a recrystallization heat treatment, the process being characterized in that:

the first drawing out is performed along the second axis (Y);

the second upsetting is performed along the second axis (Y);

the second drawing out is performed along the third axis (Z).

2. Manufacturing process according to claim 1, applied to high-density materials, such as tantalum, characterized in that it is carried out at room temperature.

3. Manufacturing process according to claim 1, characterized in that it consists in carrying out a cooling quench later than the recrystallization heat treatment.

4. Manufacturing process according to claim 1, characterized in that the first upsetting along the first axis (X) is carried out in the press and comprises the following operations:

one or more upsetting operations of the billet (1) with a forging ratio $T \leqq 2.3$ (FIG. 1);

a quench.

5. Manufacturing process according to claim 1, characterized in that the first drawing out along the second axis (Y) is performed in the press by means of the following operations:

a squaring by pressure on the faces of the billet (2, 3) which are perpendicular to the first and third axes (X) and (Z) (FIGS. 2A and 2B);

drawing out by pressure on the edges parallel to the second axis (Y) in order to obtain a billet (4) with an orthogonal profile (FIG. 2C);

a quench;

a drawing out by pressure on the center of the billet (5) in order to cause the center to neck (FIG. 2D);

a quench;

a second drawing out by action on the faces parallel to the second axis (Y) in order to obtain a billet with an octagonal profile (6) (FIG. 2E);

drawing out by pressure on the edges of this octagonal billet (6) in order to round off the latter (FIG. 2F);

a quench.

6. Manufacturing process according to claim 1, characterized in that the second upsetting along the second axis (Y) is performed in the press by means of the following operations:

forging the end faces (7A) in order to provide bearing faces on each of them;

upsetting, in one or more operations, with a forging ratio $T \leqq 2.3$ (FIG. 3), each operation followed by:

a quench.

7. Manufacturing process according to claim 1, characterized in that the second drawing out along the third axis (Z) is performed in the press by means of the following operations:

squaring by action on the faces perpendicular to the first and second axes (X) and (Y) (FIGS. 4A and 4B);

quenching;

drawing out by pressure on the center in order to cause the center to neck (FIG. 4C);

squaring by action on the faces perpendicular to the first and second axes (X) and (Y) (FIG. 4D);

drawing out by pressure on the center of the edges (11A) of the square (11) in order to cause the center of the billet (11) to neck (FIG. 4E);

drawing-out by pressure on the edges parallel to the third axis (Z) in order to obtain an octagonal profile (FIG. 4F); and quenching.

8. Manufacturing process according to claim 7, characterized in that, during the second drawing-out step along the third axis (Z), a drawing-out operation by pressure on the edges of the octagonal billet (12) is carried out in order to round off (FIG. 4G) the latter (13), after the drawing-out operation by pressure on the edges parallel to the third axis (Z) and before the final quench.

9. Process for manufacturing thin parts according to claim 1, characterized in that, before the die-forging step, the following are carried out:

a cutting-up of this billet (13) in order to obtain discs (14) (FIG. 5); and a facing, by turning, of the plane end faces of the discs (14).

10. Process for manufacturing parts made of tantalum according to claim 1, characterized in that the die-forging step comprises the following operations:

closed-die forging in a press (FIG. 6A);

sizing with a drop hammer (FIG. 6B);

quenching.

11. Manufacturing process according to claim 1, applied to tantalum billets, characterized in that the heat treatment is carried out at a temperature in the neighborhood of 970° C. for 1 h, under vacuum.

* * * * *